US011644173B2

(12) United States Patent
Han

(10) Patent No.: US 11,644,173 B2
(45) Date of Patent: May 9, 2023

(54) LAMP FOR VEHICLE AND VEHICLE INCLUDING THE SAME

(71) Applicant: HYUNDAI MOBIS CO., LTD., Seoul (KR)

(72) Inventor: Seong Yeon Han, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/849,317

(22) Filed: Jun. 24, 2022

(65) Prior Publication Data

US 2023/0028111 A1 Jan. 26, 2023

(30) Foreign Application Priority Data

Jul. 21, 2021 (KR) ..... 10-2021-0095663

(51) Int. Cl.
*F21S 41/68* (2018.01)
*F21S 41/25* (2018.01)

(52) U.S. Cl.
CPC ..... *F21S 41/68* (2018.01); *F21S 41/25* (2018.01)

(58) Field of Classification Search
None
See application file for complete search history.

(56) References Cited

FOREIGN PATENT DOCUMENTS

DE 102013108811 A1 * 2/2015 ..... F21S 48/1136

* cited by examiner

*Primary Examiner* — Elmito Breval
(74) *Attorney, Agent, or Firm* — NovoTechIP International PLLC

(57) ABSTRACT

Disclosed in a lamp for a vehicle, the lamp including a light source configured to emit light, and a pattern conversion unit disposed forward of the light source and configured to form two or more types of light distribution patterns by receiving the light emitted from the light source, in which the pattern conversion unit includes a light-transmitting member disposed to face the light source and configured to transmit the light emitted from the light source, and a polymer dispersed liquid crystal (PDLC) member provided to be in close contact with one surface of the light-transmitting member.

13 Claims, 8 Drawing Sheets

LAMP FOR VEHICLE AND VEHICLE INCLUDING THE SAME

CROSS-REFERENCE TO RELATED APPLICATIONS

This application claims the benefit of priority to Korean Patent Application No. 10-2021-0095663 filed in the Korean Intellectual Property Office on Jul. 21, 2021, the entire content of which is incorporated herein by reference.

BACKGROUND

1. Technical Field

The present disclosure relates to a lamp for a vehicle and a vehicle including the same, and more particularly, to a lamp for a vehicle, which is capable of implementing various types of light distribution patterns, and a vehicle including the same.

2. Discussion of Related Art

Lamps mounted in a vehicle to display predetermined information on a road surface are broadly classified into a reflection-type lamp including a reflector such as a multi-facet reflector (MFR) and a projection-type lamp including a mask member having through-holes having predetermined shapes.

However, in the related art, the reflection-type lamp has a large size and thus is not suitable for the trend of miniaturization. Further, the reflection type lamp may implement only a light distribution pattern having a simple shape such as a quadrangular shape. In addition, in the related art, the projection-type lamp may implement only a light distribution pattern corresponding to the shapes of the through-holes of the mask member. However, the projection-type lamp cannot implement a dynamic light distribution pattern.

SUMMARY

The present disclosure has been made in an effort to provide a lamp for a vehicle, which is capable of implementing a dynamic light distribution pattern while reducing a size of a lamp.

An exemplary embodiment of the present disclosure provides a lamp for a vehicle, the lamp including: a light source configured to emit light; and a pattern conversion unit disposed forward of the light source and configured to form two or more types of light distribution patterns by receiving the light emitted from the light source, in which the pattern conversion unit includes: a light-transmitting member disposed to face the light source and configured to transmit the light emitted from the light source; and a polymer dispersed liquid crystal (PDLC) member provided to be in close contact with one surface of the light-transmitting member.

The PDLC member may be attached to the light-transmitting member.

The PDLC member may be provided to be in close contact with a front surface of the light-transmitting member.

The pattern conversion unit may form the two or more types of light distribution patterns as light transmittance of the PDLC member is controlled by electric current applied to the PDLC member.

The PDLC member may include a first region and a second region, and the PDLC member may be controlled by a first-first step of applying electric current so that only the first region of the PDLC member transmits light for a first-first time, and a first-second step of applying electric current so that only the first region and the second region of the PDLC member transmit light for a first-second time after the first-first time.

The PDLC member may further include a third region, and the PDLC member may be controlled by the first-first step, the first-second step, and a first-third step of applying electric current so that only the first region, the second region, and the third region of the PDLC member transmit light for a first-third time after the first-second time.

The PDLC member may be provided in plural, and the PDLC members may include: a first PDLC member; and a second PDLC member provided to be in close contact with a front or rear surface of the first PDLC member.

The PDLC members may be controlled by a second-first step of applying electric current so that the entire region of the second PDLC member transmits light and only a partial region of the first PDLC member transmits light for a second-first time.

The PDLC members may further include a third PDLC member provided to be in close contact with a front or rear surface of the second PDLC member, and the PDLC members may be controlled by the second-first step, and a second-second step of applying electric current so that the entire region of the first PDLC member and the entire region of the third PDLC member transmit light and only a partial region of the second PDLC member transmits light for a second-second time after the second-first time.

The PDLC members may be controlled by the second-first step, the second-second step, and a second-third step of applying electric current so that the entire region of the first PDLC member and the entire region of the second PDLC member transmit light and only a partial region of the third PDLC member transmits light for a second-third time after the second-second time.

The lamp may further include: a collimator disposed between the light source and the pattern conversion unit; and a projection lens unit disposed forward of the pattern conversion unit.

Another exemplary embodiment of the present disclosure provides a vehicle including: a lamp for a vehicle, in which the lamp includes: a light source configured to emit light; and a pattern conversion unit disposed forward of the light source and configured to form two or more types of light distribution patterns by receiving the light emitted from the light source, and in which the pattern conversion unit includes: a light-transmitting member disposed to face the light source and configured to transmit the light emitted from the light source; and a polymer dispersed liquid crystal (PDLC) member provided to be in close contact with one surface of the light-transmitting member.

The lamp may be a backup guide lamp, a turn-signal lamp, or a welcome guide lamp.

According to the present disclosure, it is possible to provide the lamp for a vehicle, which is capable of implementing a dynamic light distribution pattern while reducing a size of the lamp.

DETAILED DESCRIPTION

Hereinafter, a lamp for a vehicle and a vehicle according to the present disclosure will be described with reference to the drawings.

Lamp for Vehicle

Figure 1:
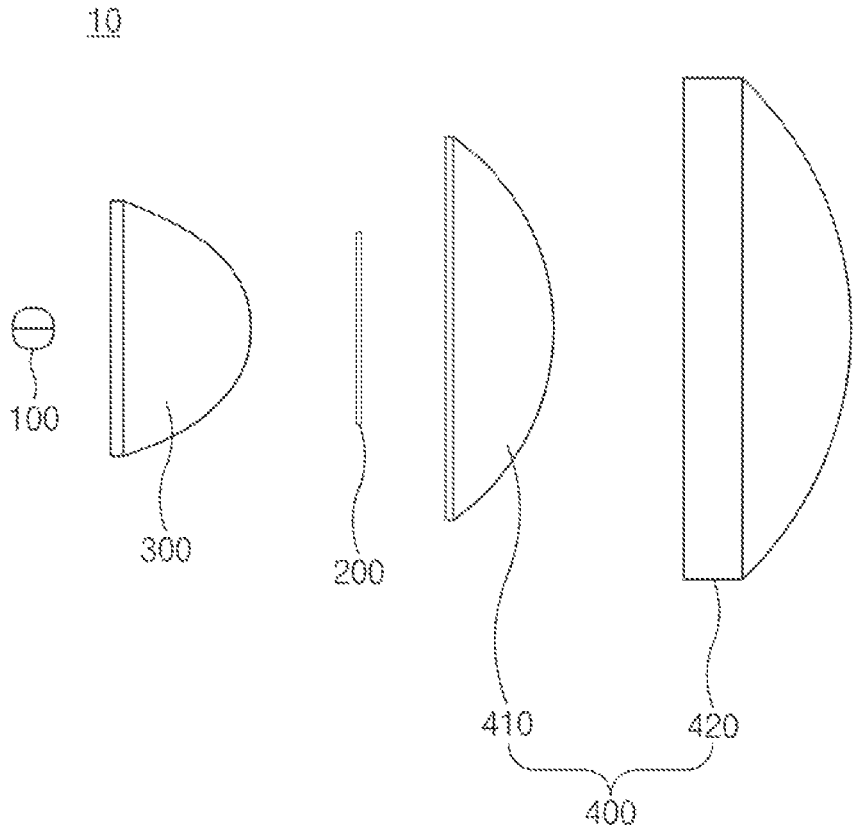
FIG. 1 is a side view illustrating a structure of a lamp for a vehicle according to the present disclosure.
Figure 2:
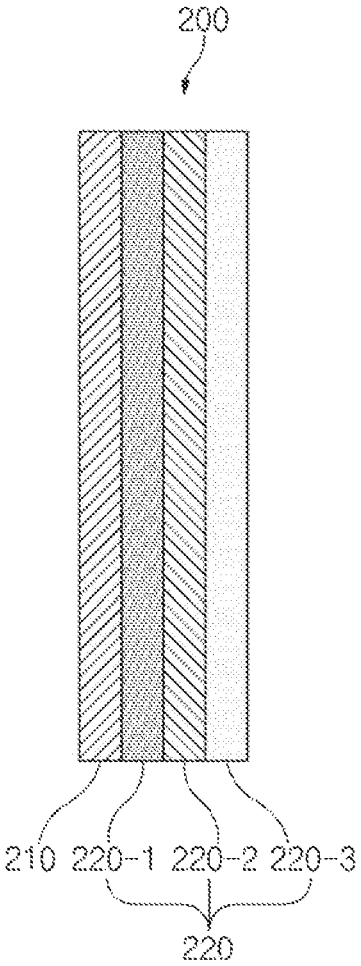
FIG. 2 is a cross-sectional view illustrating a structure of a pattern conversion unit of the lamp for a vehicle according to the present disclosure.

FIG. 1 is a side view illustrating a structure of a lamp for a vehicle according to the present disclosure, and FIG. 2 is a cross-sectional view illustrating a structure of a pattern conversion unit of the lamp for a vehicle according to the present disclosure.

Referring to FIGS. 1 and 2, a lamp 10 for a vehicle (hereinafter, referred to as a 'lamp') according to the present disclosure may include: a light source 100 configured to emit light; a pattern conversion unit 200 disposed in front of the light source 100 and configured such that the light emitted from the light source 100 enters the pattern conversion unit 200; a collimator 300 disposed between the light source 100 and the pattern conversion unit 200; and a projection lens unit 400 disposed in front of the pattern conversion unit 200.

The collimator 300 may be configured to convert the light emitted from the light source 100 into parallel light and transmit the parallel light. The description of the configuration of the collimator 300 and the principle of the collimator 300 producing the parallel light may be replaced with the publicly-known contents in the related art.

According to the present disclosure, the light, which exits the collimator 300 and enters the pattern conversion unit 200, may be converted into light with a light distribution pattern having a predetermined shape by the pattern conversion unit 200, and then the light may enter the projection lens unit 400. In particular, according to the present disclosure, the pattern conversion unit 200 may form a plurality of light distribution patterns of a plurality of types. As described below, according to the present disclosure, it is possible to implement various and dynamic light distribution patterns by controlling electric current to be applied to the pattern conversion unit 200.

The projection lens unit 400 may include a first lens 410 disposed in front of the pattern conversion unit 200, and a second lens 420 disposed in front of the first lens 410. For example, the light distribution pattern formed by the light exiting the pattern conversion unit 200 is enlarged or reduced by the first lens 410 and the second lens 420 and then displayed on the outside. The first lens 410 and the second lens 420 may each be an aspherical lens, but the type of lens is not limited thereto.

Referring to FIGS. 1 and 2, the pattern conversion unit 200 may include: a light-transmitting member 210 disposed to face the light source 100 with the collimator 300 interposed therebetween, the light-transmitting member 210 being configured to transmit the light emitted from the light source 100; and a polymer dispersed liquid crystal (PDLC) member 220 provided to be in contact with one surface of the light-transmitting member 210. More particularly, the PDLC member 220 may be attached to the light-transmitting member 210.

The light-transmitting member 210 may be configured to support the PDLC member 220. That is, the PDLC member 220 may be provided in the form of a film having a small thickness. Since the PDLC member 220 is provided to be in contact with the light-transmitting member 210, the PDLC member 220 may be kept fixed in a predetermined shape.

As described above, the light-transmitting member 210 is configured to support the PDLC member 220 without contributing to the formation of the light distribution pattern. Therefore, it is necessary to minimize the influence on the light distribution pattern formed on the outside by the lamp 10 according to the present disclosure. To this end, the light-transmitting member 210 may be made of a material excellent in light transmissivity. For example, the light-transmitting member 210 may be made of glass, polycarbonate, or acrylic.

Meanwhile, FIG. 2 illustrates that the PDLC member 220 is provided to be in contact with a front surface of the light-transmitting member 210, such that a distance between the PDLC member 220 and the light source 100 is longer than a distance between the light-transmitting member 210 and the light source 100. However, alternatively, the PDLC member 220 may be provided to be in contact with a rear surface of the light-transmitting member 210. In this case, a distance between the PDLC member 220 and the light source 100 may be shorter than a distance between the light-transmitting member 210 and the light source 100.

The PDLC has a structure in which polymer and liquid crystal are mixed at a predetermined ratio between two sheets, i.e., an ITO film and a PET film. The PDLC becomes transparent or opaque depending on whether electric current is applied. That is, the PDLC is in an opaque state in a state in which no electric current is applied to the PDLC. When electric current is applied to the PDLC, the PDLC becomes transparent.

Based on the above-mentioned description, the pattern conversion unit 200 of the lamp 10 according to the present disclosure may form the light distribution patterns of the plurality of types as light transmittance of the PDLC member 220 is controlled by electric current applied to the PDLC member 220. Therefore, according to the present disclosure, whether to transmit the light emitted from the light source 100 may be adjusted by controlling the electric current applied to the PDLC member 220. Therefore, it is possible to implement various types of light distribution patterns and implement a light distribution pattern of a dynamic image that changes over time.

Meanwhile, the lamp 10 according to the present disclosure may be a backup guide lamp, a turn-signal lamp, or a welcome guide lamp. In particular, according to the present disclosure, it is possible to implement a light distribution pattern of a dynamic image that changes over time. Hereinafter, a method of implementing a light distribution pattern of a dynamic image by using the lamp according to the present disclosure will be described.

Figure 3:
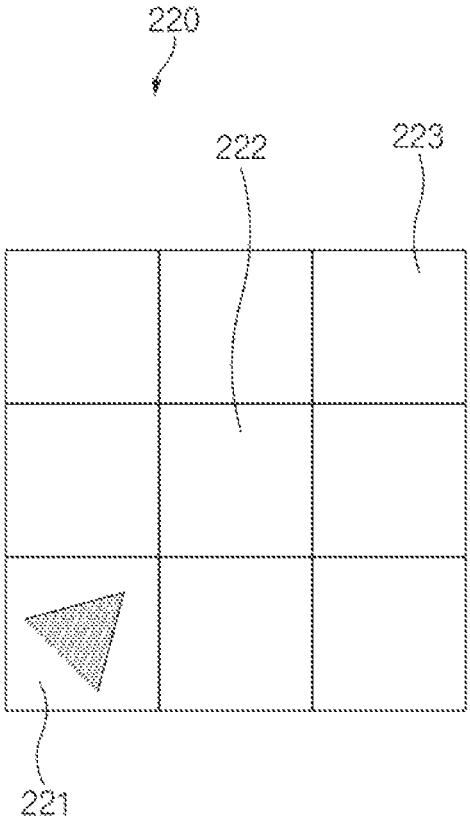
FIG. 3 is a view illustrating a state in which a PDLC member of the lamp for a vehicle according to the present disclosure transmits light in a first-first step.
Figure 4:
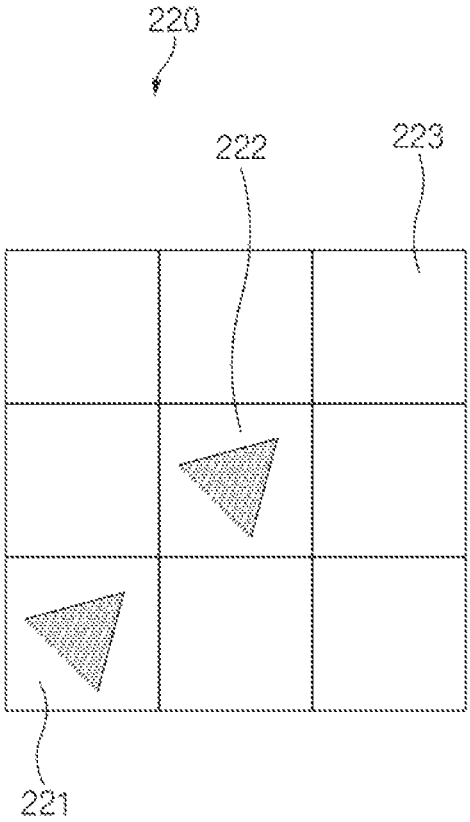
FIG. 4 is a view illustrating a state in which the PDLC member of the lamp for a vehicle according to the present disclosure transmits light in a first-second step.

FIG. 3 is a view illustrating a state in which the PDLC member of the lamp for a vehicle according to the present disclosure transmits light in a first-first step, and FIG. 4 is a view illustrating a state in which the PDLC member of the lamp for a vehicle according to the present disclosure transmits light in a first-second step. In addition, FIG. 5 is a view illustrating a state in which the PDLC member of the lamp for a vehicle according to the present disclosure transmits light in a first-third step.

Figure 5:
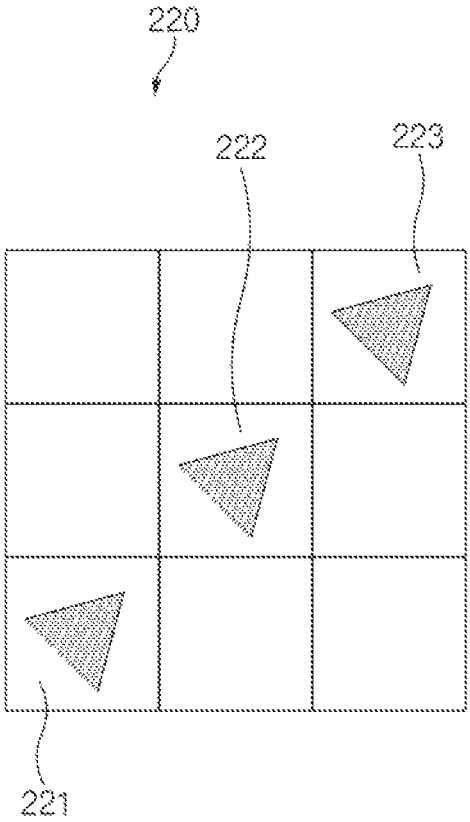
FIG. 5 is a view illustrating a state in which the PDLC member of the lamp for a vehicle according to the present disclosure transmits light in a first-third step.

Referring to FIGS. 3 to 5, the PDLC member 220 of the lamp according to the present disclosure may be divided into a plurality of regions. In this case, whether to apply electric current to the plurality of regions may be independently controlled. For example, the PDLC member 220 may be divided into nine regions disposed in three rows and three columns.

For example, the PDLC member 220 may include a first region 221, a second region 222, and a third region 223.

In this case, according to the present disclosure, the PDLC member 220 may be controlled by a first-first step (see FIG. 3) of applying the electric current so that only the first region 221 of the PDLC member 220 transmits the light for a first-first time (first time period), a first-second step (see FIG. 4) of applying the electric current so that the only the first region 221 and the second region 222 of the PDLC member 220 transmit the light for a first-second time (second time period) after the first-first time, and a first-third step of applying the electric current so that only the first region 221, the second region 222, and the third region 223 of the PDLC member 220 transmit the light for a first-third time (third time period) after the first-second time. In this case, as illustrated in FIGS. 3 to 5, a light distribution pattern, in which triangular light distribution patterns are arranged in one direction as the number of triangular light distribution patterns increases by one as time elapses, may be formed on the road surface. Therefore, according to the present disclosure, the shape of the light distribution pattern may change over time, thereby implementing the dynamic light distribution pattern.

Figure 6:
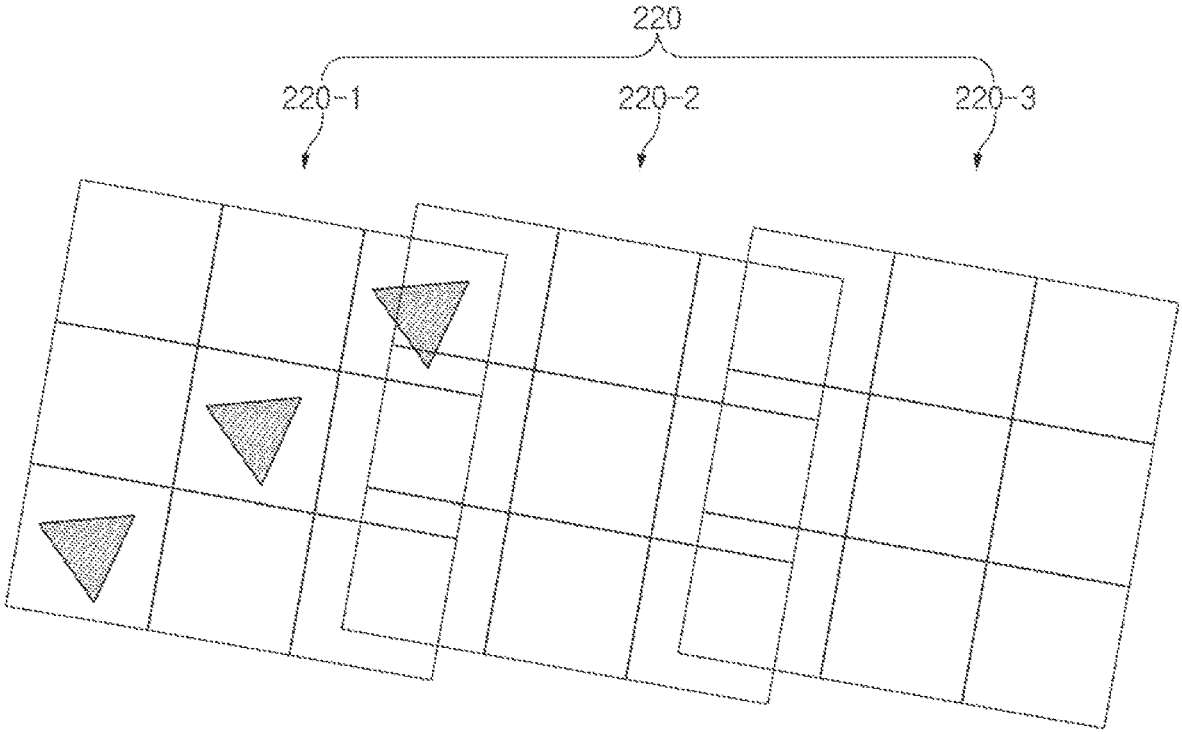
FIG. 6 is a view illustrating a state in which the PDLC member of the lamp for a vehicle according to the present disclosure transmits light in a second-first step.
Figure 7:
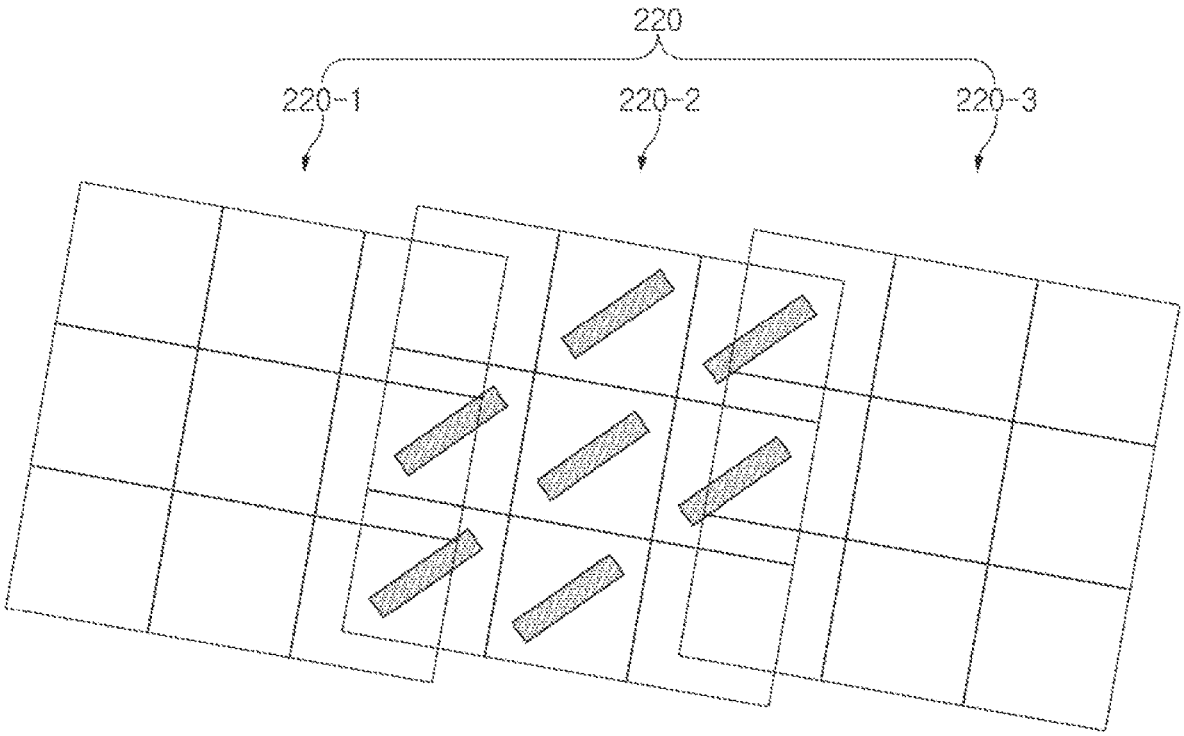
FIG. 7 is a view illustrating a state in which the PDLC member of the lamp for a vehicle according to the present disclosure transmits light in a second-second step.
Figure 8:
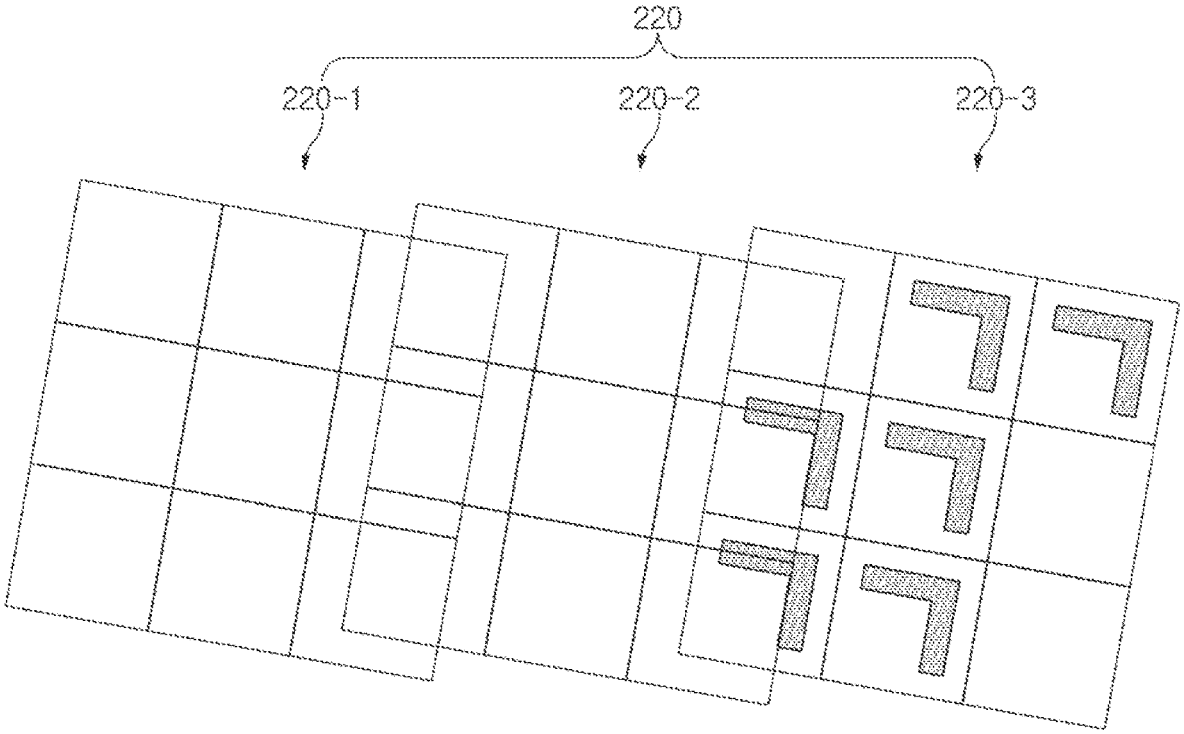
FIG. 8 is a view illustrating a state in which the PDLC member of the lamp for a vehicle according to the present disclosure transmits light in a second-third step.

FIG. 6 is a view illustrating a state in which the PDLC member of the lamp for a vehicle according to the present disclosure transmits light in a second-first step, and FIG. 7 is a view illustrating a state in which the PDLC member of the lamp for a vehicle according to the present disclosure transmits light in a second-second step. In addition, FIG. 8 is a view illustrating a state in which the PDLC member of the lamp for a vehicle according to the present disclosure transmits light in a second-third step.

As illustrated in FIGS. 2, 6, 7, and 8, the PDLC member 220 may be provided in plural. For example, the PDLC members 220 may include a first PDLC member 220-1, and a second PDLC member 220-2 provided to be in contact with a front or rear surface of the first PDLC member 220-1. In the case in which the PDLC member 220 is provided to be in contact with the front surface of the light-transmitting member 210, the first PDLC member 220-1 may be attached to the front surface of the light-transmitting member 210, and the second PDLC member 220-2 may be attached to the front surface of the first PDLC member 220-1.

In this case, according to the present disclosure, the PDLC members 220 may be controlled by the second-first step (see FIG. 6) of applying the electric current so that the entire region of the second PDLC member 220-2 transmits the light and only a partial region of the first PDLC member 220-1 transmits the light for a second-first time (fourth time period). In this case, the light distribution pattern formed by the lamp according to the present disclosure may be formed by the light transmitted only through the partial region of the first PDLC member 220-1. For example, a light distribution pattern in which a plurality of triangular light distribution patterns is arranged in one direction may be formed on the road surface by the first PDLC member 220-1.

Meanwhile, in addition to the first PDLC member and the second PDLC member, the PDLC members 220 may further include a third PDLC member 220-3 provided to be in contact with a front or rear surface of the second PDLC member 220-2. For example, the third PDLC member 220-3 may be attached to the front surface of the second PDLC member 220-2.

In the case in which the PDLC members 220 according to the present disclosure further include the third PDLC member 220-3, the electric current may be applied in the second-first step so that the entire region of the second PDLC member 220-2 and the entire region of the third PDLC member 220-3 transmit the light and only a partial region of the first PDLC member 220-1 transmits the light for the second-first time. In this case, as described above, the light distribution pattern formed by the lamp according to the present disclosure may be formed by the light transmitted only through the partial region of the first PDLC member 220-1.

Meanwhile, in the case in which the PDLC members 220 include the third PDLC member 220-3, in addition to the second-first step, the PDLC members 220 may be controlled by a second-second step (see FIG. 7) of applying the electric current so that the entire region of the first PDLC member 220-1 and the entire region of the third PDLC member 220-3 transmit the light and only a partial region of the second PDLC member 220-2 transmits the light for a second-second time (fifth time period) after the second-first time. In this case, the light distribution pattern formed by the lamp according to the present disclosure may be formed by the light transmitted only through the partial region of the second PDLC member 220-2. For example, a light distribution pattern in which a plurality of straight light distribution patterns is arranged in one direction may be formed on the road surface by the second PDLC member 220-2.

Meanwhile, in the case in which the PDLC members 220 include the third PDLC member 220-3, in addition to the second-first step and the second-second step, the PDLC members 220 may be controlled by a second-third step (see FIG. 8) of applying the electric current so that the entire region of the first PDLC member 220-1 and the entire region of the second PDLC member 220-2 transmit the light and only a partial region of the third PDLC member 220-3 transmits the light for a second-third time (sixth time period) after the second-second time. In this case, the light distribution pattern formed by the lamp according to the present disclosure may be formed by the light transmitted only through the partial region of the third PDLC member 220-3. For example, a light distribution pattern in which a plurality of L-shaped light distribution patterns is arranged in one direction may be formed on the road surface by the third PDLC member 220-3.

According to the present disclosure, the lamp for a vehicle may include the plurality of PDLC members in a forward/rearward direction, thereby implementing various types of light distribution patterns. That is, in order to form a predetermined light distribution pattern, the electric current is controlled such that the light may be transmitted only through the region in which the PDLC member capable of forming the predetermined light distribution pattern has a shape corresponding to the predetermined light distribution pattern, and the light may be transmitted through the entire regions of the remaining PDLC members. Therefore, it is possible to implement various types of light distribution patterns.

Meanwhile, all the above-mentioned first-first, first-second, and first-third steps and the second-first, second-second, and second-third steps may be applied to the lamp according to the present disclosure. More specifically, the above-mentioned first-first, first-second, and first-third steps may be performed to implement light distribution patterns having dynamic shapes over time by using the single PDLC member. The above-mentioned second-first, second-second, and second-third steps may be performed to different types of light distribution patterns that perform different functions over time when the plurality of PDLC members is provided.

Vehicle

A vehicle according to the present disclosure may include the lamp 10 for a vehicle. In this case, the lamp 10 may include: the light source 100 configured to emit light; and the pattern conversion unit 200 disposed in front of the light source 100 and configured to form the light distribution patterns of the plurality of types by receiving the light emitted from the light source. The pattern conversion unit 200 may include: the light-transmitting member 210 disposed to face the light source 100 and configured to transmit the light emitted from the light source 100; and the polymer dispersed liquid crystal (PDLC) member 220 provided to be in contact with one surface of the light-transmitting member 210.

The lamp may be a backup guide lamp, a turn-signal lamp, or a welcome guide lamp. The detailed description for the lamp provided in the vehicle according to the present disclosure may be replaced with the above-mentioned description for the lamp for a vehicle according to the present disclosure.

The present disclosure has been described with reference to the limited embodiments and the drawings, but the present disclosure is not limited thereto. The present disclosure may be carried out in various forms by those skilled in the art, to which the present disclosure pertains, within the technical spirit of the present disclosure and the scope equivalent to the appended claims.

What is claimed is:

1. A lamp for a vehicle, comprising:

a light source configured to emit light; and a pattern conversion unit positioned to receive the light emitted from the light source and configured to generate, based on the received light, a plurality of light distribution patterns, wherein the pattern conversion unit comprises:

a light-transmitting member facing the light source and configured to transmit the light emitted from the light source; and a polymer dispersed liquid crystal (PDLC) member in contact with the light-transmitting member and comprising:

a first PDLC member divided into a plurality of regions, each region of the first PDLC member configured to generate a first light distribution pattern based on the light transmitted from the light source through the light-transmitting member; and a second PDLC member in contact with the first PDLC member and divided into a plurality of regions arranged corresponding to the plurality of regions of the first PDLC member, respectively, each region of the second PDLC member having a shape and size corresponding to those of a corresponding region of the first PDLC member and configured to generate a second light distribution pattern different from the first light distribution pattern based on the light transmitted from the light source through the light-transmitting member and the first PDLC member, wherein the pattern conversion unit is configured to individually control a light transmittance of each region of the first and second PDLC members to generate the plurality of light distribution patterns.

2. The lamp of claim 1, wherein the PDLC member is attached to the light-transmitting member.

3. The lamp of claim 1, wherein:

the light-transmitting member has first and second surfaces facing mutually opposed directions, the first surface of the light-transmitting member facing the light source, and the PDLC member is in contact with the second surface of the light-transmitting member.

4. The lamp of claim 1, wherein the pattern conversion unit is configured to selectively apply a current to each region of the first and second PDLC members to individually control the light transmittance of the regions of the first and second PDLC members.

5. The lamp of claim 1, wherein:

the plurality of regions of the first PDLC member includes first and second regions, and the PDLC member is configured to:

cause the first region to transmit the received light at a first time period, and cause the first and second regions to transmit the received light at a second time period following the first time period.

6. The lamp of claim 5, wherein:

the plurality of regions of the PDLC member further includes a third region, and the PDLC member is configured to cause the first, second region and third regions to transmit the received light at a third time period following the second time period.

7. The lamp of claim 1, wherein the PDLC member is configured to cause the entire regions of the second PDLC member and some of the regions of the first PDLC member to transmit the received light at a first time period.

8. The lamp of claim 7, wherein:

the PDLC member further comprise a third PDLC member in contact with the second PDLC member, the third PDLC member divided into a plurality of regions, and the PDLC member is configured to cause the entire regions of the first and third PDLC members and some of the regions of the second PDLC member to transmit the received light at a second time period following the first time period.

9. The lamp of claim 8, wherein the PDLC member is configured to cause the entire regions of the first and second PDLC members and some of the regions of the third PDLC member to transmit the received light at a third time period following the second time period.

10. The vehicle of claim 8, wherein the plurality of regions of the third PDLC member are arranged corresponding to the plurality of regions of the second PDLC member, respectively, each region of the third PDLC member having a shape and size corresponding to those of a corresponding region of the second PDLC member and configured to generate a third light distribution pattern different from the first and second light distribution patterns based on the light transmitted from the light source through the light-transmitting member and the first and second PDLC members.

11. The lamp of claim 1, further comprising:

a collimator disposed between the light source and the pattern conversion unit; and a projection lens unit disposed in front of the pattern conversion unit.

12. A vehicle comprising the lamp of claim 1.

13. The vehicle of claim 12, wherein the lamp comprises a backup guide lamp, a turn-signal lamp or a welcome guide lamp of the vehicle.

* * * * *